United States Patent [19]

Howe

[11] 4,222,484

[45] Sep. 16, 1980

[54] ANTIPROPAGATION EXPLOSIVE PACKAGING MEANS

[75] Inventor: Philip M. Howe, Conowingo, Md.

[73] Assignee: The United States of America as represented by the Secretary of the Army, Washington, D.C.

[21] Appl. No.: 42,825

[22] Filed: May 29, 1979

[51] Int. Cl.[3] ..... B65D 81/08; B65D 85/30; F42B 37/00; F42B 39/00

[52] U.S. Cl. ..... 206/3; 206/443; 206/593

[58] Field of Search ..... 206/3, 443, 454, 593, 206/591

[56] References Cited

U.S. PATENT DOCUMENTS

| | | | |
|---|---|---|---|
| 2,835,381 | 5/1958 | Ackermann et al. | 206/443 |
| 3,403,777 | 10/1968 | Bucko | 206/454 |
| 3,525,425 | 8/1970 | Cramer et al. | 206/3 |

*Primary Examiner*—William T. Dixson, Jr.
*Attorney, Agent, or Firm*—Nathan Edelberg; Robert P. Gibson; Harold H. Card, Jr.

[57] ABSTRACT

A packaging system is disclosed for containing a plurality of discrete explosive masses in close juxtaposition but isolated from each other so as to prevent detonation of one such mass from propagating a chain of further detonations of the remaining such masses.

9 Claims, 4 Drawing Figures

ANTIPROPAGATION EXPLOSIVE PACKAGING MEANS

STATEMENT OF GOVERNMENT INTEREST

The invention described herein may be manufactured, licensed, and used by or for the Government for Governmental purposes without the payment to me of any royalty thereon.

BACKGROUND OF THE INVENTION

For purposes of transportation and storage, munitions are classified according to the nature, level or extent of potential damage which would result through accidental or untimely explosion of the munition involved. One of the most hazardous categories in such classification is the "mass detonating" class of munitions wherein detonation of one munition in close proximity with other similar munitions will cause most or all of the others to detonate. The violence and consequent loss, damage and injury from the resulting explosion is proportional to the total number of munitions in the package or assemblage. In the absence of measures which can effectively prevent interround propagation of munitions in an aggregation or ensemble mode of packaging, such items must be isolated from each other by individual packaging, remote dispersal and single-step handling procedures, all of which increase weight, overall bulk, time consumption, labor and material costs for packaging, handling, shipping and storing munitions in the "mass detonating" category.

SUMMARY OF THE INVENTION

The invention in this case comprises a unique packaging and shielding technique which permits a plurality of munitions such as explosive warheads to be packaged together in a single container for shipment or storage with little or no risk of interround propagation in the event that one warhead detonates. A coherent solid mass of vibration-damping and moisture-resistant material has a plurality of spaced-apart cavities formed therein to receive the individual warheads in nesting relationship. A shock-attenuating shield is generally aligned midway between each of the mentioned cavities to interrupt transmission of shock effects through precise dimensional sizing and placement. This results in hazard free packaging of mass detonating explosives in containers of low-density, light weight, inexpensive materials and low-bulk, conveniently sized shipping units.

DESCRIPTION OF THE PREFERRED EMBODIMENT

Figure 1:
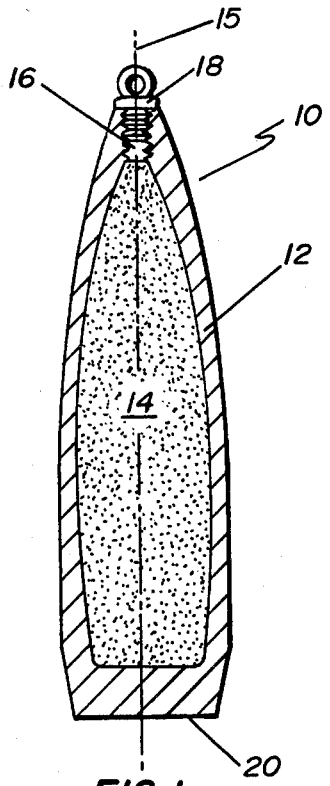
FIG. 1 is an isolated elevational fragmentary view, partly in cross-section, of a munition for which the invention is adapted to be used in transporting, handling and storing explosive materials.

Referring to FIG. 1, a munition item illustratively comprising an elongate, generally cylindrical warhead, such as artillery projectile or round 10 has a hollow steel ogive casing 12 with a column of explosive material 14 contained therein. Casing 12 is symmetrical about a center longitudinal axis 15. Ammunition round or projectile 10 could be a grenade, a mine, or any other exploding munition having "mass detonating" characteristics such that detonation of a single item in close proximity with other similar items would result in detonation of most or all such items, either sequentially or simultaneously. Projectile 12 typically is provided with mounting means for securing a fuze thereto for initiating detonation of the main explosive charge, and in FIG. 1 such mounting means consists of threaded hole 16 on the projectile nose. During shipping and storage, however, the fuze is not secured to the projectile and hole 16 is sealed by a removable plug 18. In the case of hand grenades, however, fuzes are normally mounted thereto as a final step in manufacture and remain throughout the life of the grenade. It will be understood that the inventive concept in this case does not depend on any specific choice of munition used to describe the concept.

Figure 2:
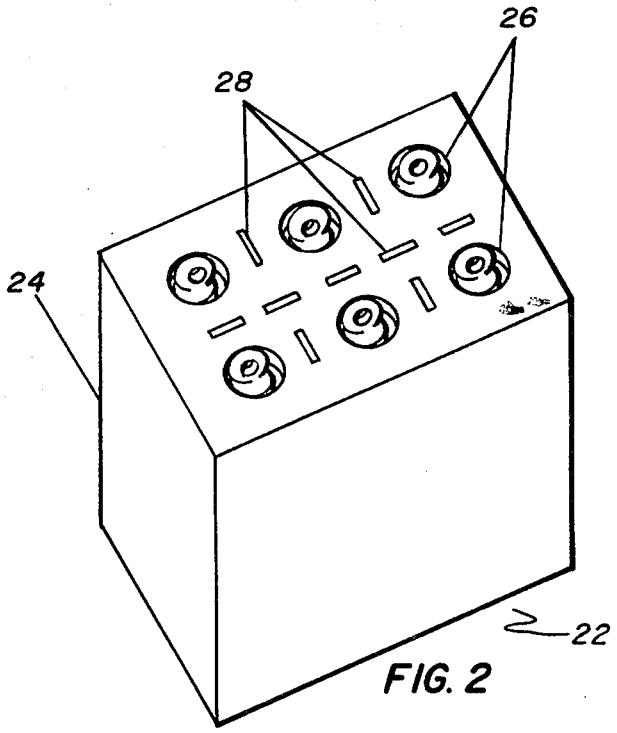
FIG. 2 is a perspective view of the inventive shipping container operatively related to the FIG. 1 structure.

FIG. 2 shows a shipping and storing container 22 for a plurality of explosive munitions such as projectile 10. According to the invention in this case, container 22 comprises a chemically inert, moisture proof and substantially rigid, low density, light weight and continuous mass 24 such as styrofoam or any commerically available synthetic composition of wood or paper. Mass 24 is provided with a plurality of holes or cavities 26 therein, each dimensioned so as to receive projectile 10 in snug nesting relationship whereby the external surfaces of the projectile along a substantial portion of its length are in generally uniform area contact with the surrounding surface of the cavity.

Mass 24 is further provided with a plurality of elongate tubes or rods 28 of low shock impedance material having relatively greater density than mass 24. Rods 28 functions as shields and are situated between projectiles 10 so as to interrupt a trajectory line from the center axis of each warhead to the center axis of its nearest neighbor warhead. Rods 28 in FIG. 2 have a length not less than the vertical length of explosive column 14 in FIG. 1, and are rectangular or oblong in cross-section. The rods are situated with respect to cavities 26 in a manner described more fully below.

Figure 3:
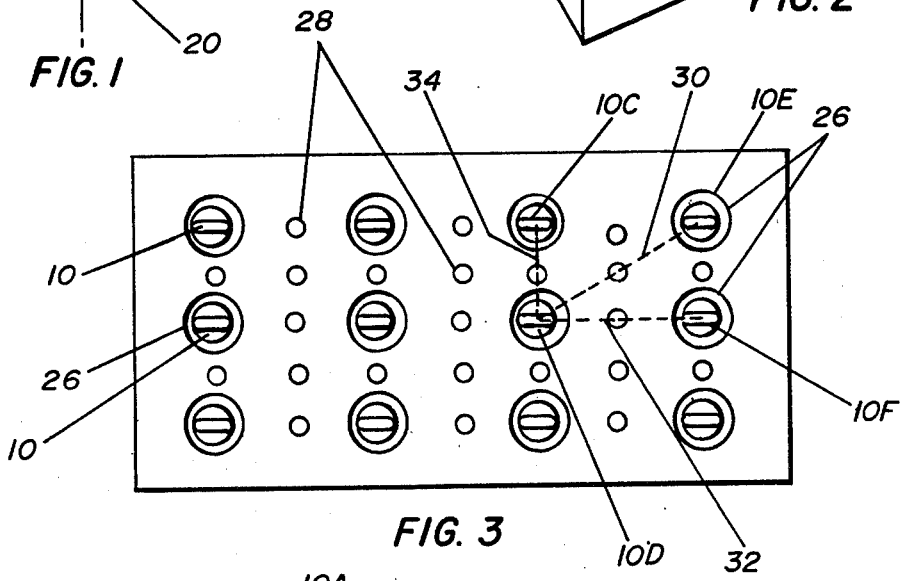
FIG. 3 is a top plan view of structure corresponding to FIG. 2, in a modified form.

FIG. 3 shows a storage and shipping container of generally similar construction to that seen in FIG. 2 and having a plurality of projectiles 10 in a like number of cavities 26. However, elongate rods or shields as in FIG. 3 are round in cross-section, hence of substantially cylindrical shape. Thus it may be seen from a comparison between FIGS. 2 and 3 that the cross-sectional shape of rods 28 is not critical to the concept in this case, but rather the placement of such rods in relation to each other and to projectiles 10.

With specific regard to FIG. 3, it will be understood that each of the projectiles in the various cavities 26 is symmetrical about a center axis in the same manner as the projectile shown in FIG. 1 about axis 15. It then follows that the elongate column of explosive 14 seen in FIG. 1 is also symmetrical about the same axis. Placement of rods 28 in FIGS. 2 and 3 is such that each rod interrupts a line connecting the center axes of each explosive column in the projectiles nearest each rod. This is demonstrated by lines 30, 32 and 34 in FIG. 3 connecting the center axis of projectiles 10C, 10D, 10E and 10F. Each of the lines 30, 32 and 34 represents a direct path of explosive shock or force which would be transmitted to closest neighboring projectiles in the event that one projectile detonates. By interrupting this path, transfer of such force is modified in direction or intensity, or both by the shields 28. Many tests have been performed which prove that shipping containers such as seen in FIGS. 2 and 3 having rods 28 situated between cavities 26 in the mentioned relationship are effective in avoiding mass-detonation effects when one projectile in the container is intentionally detonated.

Figure 4:
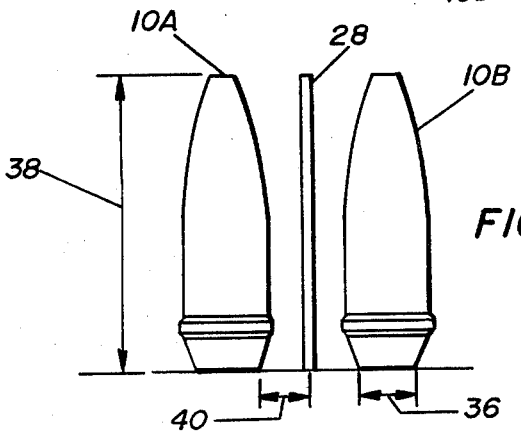
FIG. 4 is an isolated elevational view of structural elements interrelated in the manner of FIG. 3.

Some criticality in achieving the objectives of this invention resides in the relative size and spacing of rods 28 in reference to explosive column 14 shown in FIG. 1. This can be seen from FIG. 4 wherein reference numeral 36 denotes the average or mean diameter of the explosive column within projectile 10B while numeral 40 denotes the distance between the similar column within projectile 10A and rod 28. The factors which determine the best optimum size and relationship between items 10A, 10B and 28 are related to the mechanisms by which detonation and violent reaction propagate from round to round. Thus, when an explosive warhead such as projectile 10 is detonated, large amounts of energy are released rapidly. The warhead casing is accelerated to velocities on the order of 1 kilometer per second, as radial expansion of the explosive products occurs. Where R is the radius of the casing 12 and $R_B$ is any radial distance from axis 15 traveled by the casing upon detonation of explosive column 14, breakup of the casing into individual fragments occurs when $(R_B/R)$ is approximately 1.2. As $(R_B/R)$ increases, the spacing between fragments also increases until as $(R_B/R)$ approaches 3, each fragment must be treated individually in the analysis of impact phenomena.

It is a critical factor of this invention that, at low values of the ratio $(R_B/R)$, the impact process can be approximated by considering the fragments collectively as substantially equivalent to a plate impact. Protective shields 28 exploit this fact. Thus, materials such as plastic may be used as shields where the interround separation is small, because the plastic is effective in serving as a barrier and shock attenuator under plate impact conditions. At large separations, the plastic would be ineffectual because it is easily perforated by individual fragments of casing 12.

It is also critical to this invention that initiation of violent reaction or detonation involves (a) ignition of some small element of the explosive, by raising its temperature through shock loading, frictional heating, heat transfer from a hot fragment, etc., and (b) spread of reaction, the rate of which is proportional to the degree of damage suffered by the target warhead. Plastic shields 28 placed between neighboring munitions are effective in preventing fragments from causing ignition of the target warheads. Without an ignition source, the target warheads can suffer extensive damage without reacting or detonating. The specific geometry of the plastic shield is unimportant, as long as there is no unimpeded trajectory from source warhead to target warhead. Effective shielding is provided if the plastic thickness is equal to or greater than 1.5 w, where w is the donor warhead casing thickness. The donor warhead is the exploding projectile such as 10D in FIG. 3. The mechanism by which the shields work is (a) prevention of direct impact on target by fragments of donor casing and (b) attenuation of the shock wave, as a result of the low shock impedance of the plastic shields. Because the shielding mechanism relies upon the two factors, (a) and (b) above, shields can be made from any material which has sufficient structural integrity to prevent direct fragment impact upon the target warheads and which has a low shock impedance. Thus, any plastic with density in the range from about 0.8 grams per cubic centimeters to 1.55 grams per cubic centimeters will work, and materials such as low density foamed aluminum and steel will also work in addition to any other materials within such density range. Polyurethane and polyethylene have each been tested with success in shields 28.

It will be understood that mass 24 is not critical to the inventive concept and that any securing means will suffice to hold munitions 10 in relatively fixed relationship with each other and with shields 28. Thus, partitioned cartons or pallets engaging only the upper and lower ends of the munitions and securing low impedance shields 28 in the relationship shown, for example, in FIGS. 2 or 3, may be substituted in place of mass 24. Also, the width of shields 28 is preferably about half the diameter of explosive column 14, but may be less as seen in the drawings. Moreover, shields 28 should be situated not more than about 2.5 times the radius of casing 12 away from center axis 15 in order to assure that fragments from the casing will exhibit plate impact characteristics rather than individual fragment behavior.

The foregoing disclosure and drawings are merely illustrative of the principles of this invention and are not to be interpreted in a limiting sense. I wish it to be understood that I do not desire to be limited to the exact details of construction shown and described because obvious modifications will occur to a person skilled in the art.

I claim:

1. In a container for a plurality of individual explosive munitions;

support means for supporting said munitions in spaced-apart relationship, and shield means consisting of elongate rods of low shock impedance material, one of said rods being secured within said container midway between each of said spaced-apart munitions.

2. The structure in claim 1 wherein:

each of said munitions is elongate in form and substantially symmetrical about a center longitudinal axis, and each of said rods is parallel to said axis and substantially of the same length as said elongate munitions.

3. The structure in claim 2 wherein:

said support means comprises a low density lightweight plastic mass adapted to receive each of said munitions in snugly nesting relationship.

4. The structure in claim 2 wherein:

said rods are polyurethane material.

5. The structure in claim 2 wherein:

said rods are polyethylene material.

6. In a container for explosive munitions:

a plurality of explosive munitions, security means for securing said plurality of munitions in fixed and spaced-apart interrelationship, and an elongate shield affixed midway between each of said munitions, said shield having a density within the range from about 0.8 to 1.55 grams per cubic centimeter.

7. The structure in claim 6, wherein:

each of said munitions includes an outer casing having a thickness, and each of said shield has a thickness at least equal to said casing thickness.

8. The structure set forth in claim 6, wherein:

each of said munitions has an elongate column of explosive material contained therewithin, and each of said shields has a length substantially equal to the length of said column.

9. The structure set forth in claim 7, wherein:

each of said casings has a substantially cylindrical shape having a radius about a center longitudinal axis, and each of said shields is situated not more than 2.5 times said radius.

* * * * *